US006299123B1

(12) United States Patent
Hayde

(10) Patent No.: US 6,299,123 B1
(45) **Date of Patent: *Oct. 9, 2001**

(54) ADJUSTABLE HANGING SYSTEM

(76) Inventor: George Shandor Hayde, Koempelstrasse 14, 82340 Feldafing (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/499,169

(22) Filed: Feb. 7, 2000

(51) Int. Cl.[7] ..... A47B 65/00
(52) U.S. Cl. ..... 248/476; 248/495
(58) Field of Search ..... 248/476, 480, 248/475.1, 495; 40/757

(56) References Cited

U.S. PATENT DOCUMENTS 3,630,476 * 12/1971 Lococo ..... 248/476
4,892,284 * 1/1990 Kelrick ..... 248/476
5,878,987 * 3/1999 Hayde ..... 248/495 X

* cited by examiner

*Primary Examiner*—Ramon O. Ramirez
(74) *Attorney, Agent, or Firm*—Kajane McManus

(57) ABSTRACT

The system for adjustably mounting an item to a vertical surface comprises a track and cooperating head of an attachment member slidably engaged to one another. One of the system structures engages an item to be mounted and the other of the system structures engages the vertical surface. Relative position between the structures may be adjusted and maintained, with the structures being releasably locked together once engaged. Further, if desired, the system may be engaged to an alarm apparatus to alert of tampering with the system.

7 Claims, 1 Drawing Sheet

FIG. 1
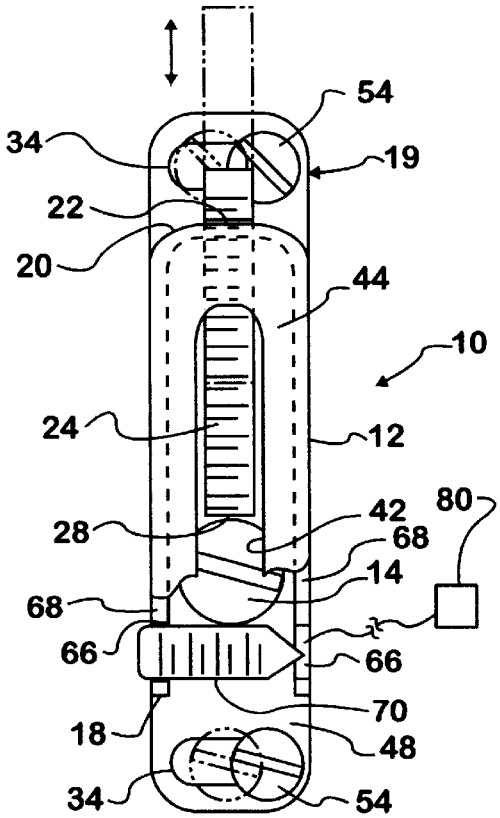
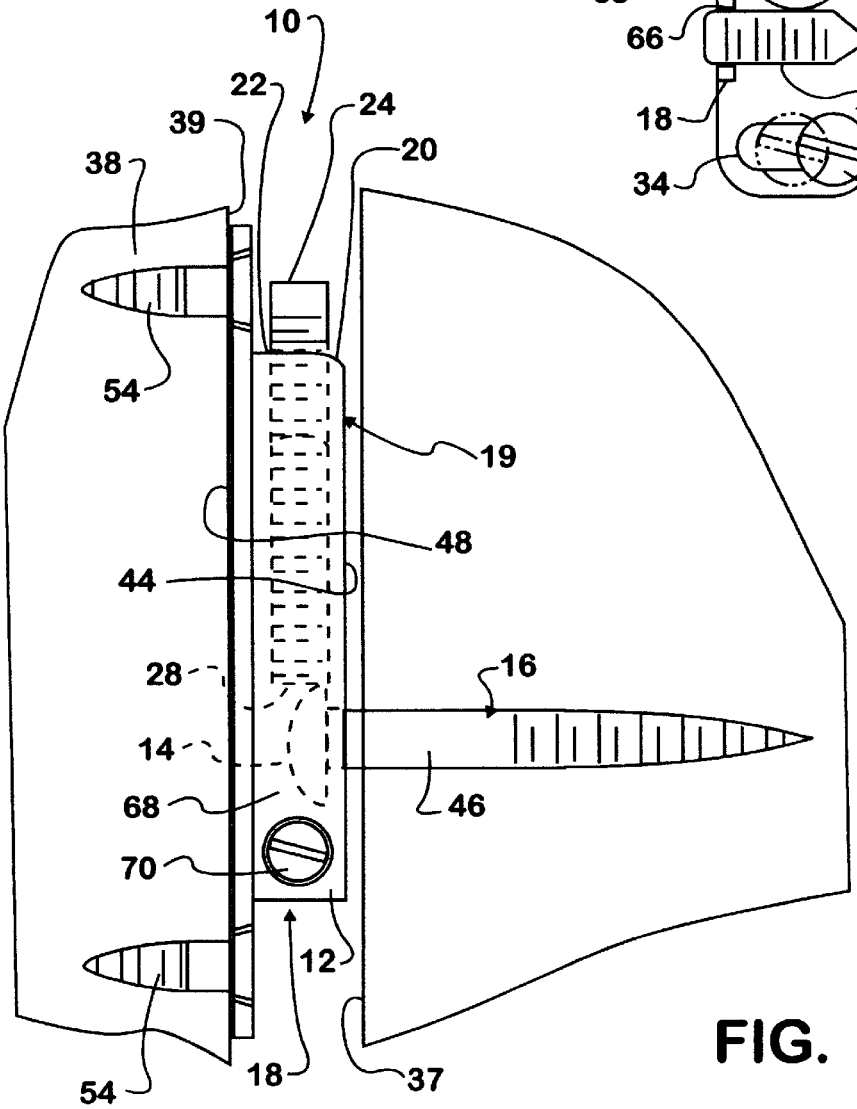
FIG. 2

ADJUSTABLE HANGING SYSTEM

BACKGROUND OF THE INVENTION

1. Field of the Invention

The present invention relates to an adjustable hanging system. More particularly, the system includes a track which is engaged over and movable relative to the head of an attachment member, such as a screw, to allow for desired positioning of an object to be hung, such as a picture.

The structures of the system can be locked together to prevent theft of an item hung therewith and also accommodate engagement to a security system, if desired.

2. Prior Art

Heretofore, there has been proposed in U.S. Pat. No. 5,878,987 an adjustable hanging system including a track which slides relative to a slide therein, which is owned by the applicant herein, and the teachings of which are incorporated herein.

The system has been found to be very well received by museums and the like for hanging larger works of art. However, it has been found to be of excessive bulk when dealing with smaller articles to be hung.

Accordingly, there is proposed herein a smaller and less complicated system for use in hanging smaller objects, the bulk of the system having been reduced by elimination of the slide, with engagement of the track being directly to and over the head of an attachment member, such as a screw and, with the track also being engaged directly either to the item to be hung or the vertical supporting surface, and the attachment member being engaged directly to the opposite structure.

SUMMARY OF THE INVENTION

According to the invention there is provided an adjustable hanging system for mounting an item to a vertical surface, the system comprising a track and a head of an attachment member slidably engaged to one another and including means for maintaining relative position therebetween, the track having means for further engaging directly to either of said vertical surface and said item and the head of the attachment member being suitably engaged to either of said item and said vertical surface.

BRIEF DESCRIPTION OF THE DRAWINGS

FIG. 1 is a perspective view of the hanging system of the present invention.

FIG. 2 is a perspective view of the hanging system showing same in use in adjustably engaging a structure such as a picture frame to a vertical supporting structure, such as a wall.

DESCRIPTION OF THE PREFERRED EMBODIMENT

Referring now to the drawings in greater detail, there is illustrated therein the adjustable hanging system made in accordance with the teachings of the present invention and generally identified by the reference numeral 10.

As shown, the system 10 includes a hollow track 12 within which a head 14 of an attachment member 16, such as a screw 16, is slidably received. The track 12 has an open end 18 through which the head 14 enters the track 12, with an opposite end 19 of the track 12 being closed off by an end wall 20.

Within this end wall 20 is a threaded opening 22 which receives a threaded positioning connector or bolt 24, with a head 26 of the connector 24 resting outwardly of the track 12. An opposite end 28 of the threaded connector 24 engages against the head 14 of the screw 16.

The track 12 further has a pair of horizontally ovaled throughbores 34 therein, one throughbore 34 positioned in each end flange 36 of the track 12, which are provided for use in engaging the track 12 to a vertical support surface 37 such as a wall 37 or a rear surface 39 of an item 38 such as a picture frame 38 to be hung from the vertical support surface 37. The throughbores 34 are ovaled so that horizontal adjustment for desired or required positioning is possible.

It will be understood that the track 12 and head 14 are sized and configured to slidingly cooperate with each other, with their configuration further being such that the track 12 cannot be disconnected from head 14 except by sliding the head 14 out through the open end 18 of the track 12.

For purposes of engagement, the track 12 includes a center channel 42 in one front surface 44 thereof through which a shaft 46 of the screw 16 extends while the head 14 is cooperatively engaged within the track 12.

It will also be seen that another surface 48 of the track 12, which is opposite the surface 44 having the channel 42 therein, is separated from the surface 44 by a distance sufficient to allow slidable engagement of the head 14 within an essentially three sided, hollow track 12.

It will be understood further that it is desirable to be able to simply lock the track 12 and head 14 together so that the item 38 suspended by the system 10 cannot be easily removed therefrom.

For this purpose, the track 12 is elongated, and a throughbore 66 is provided in each sidewall 68 of the track 12. A further threaded connector 70, having a length greater than the width of the track 12 is engaged across the open end 18 of the track 12, by threading same through the pair of throughbores 66, effectively locking the head 14 within the track 12.

Engagement and locking of the head 14 and track 12 together are performed only after the individual elements 12 and 14 are appropriately engaged to their respective structure surfaces 37, 39 producing a locked in place vertical mounting of the item 38 as best illustrated in FIG. 2.

Here, the head 14 is fixed to the vertical support surface or wall 37 by threading of the shaft 46 of the screw 16 into the wall 37 and the track 12 is seen engaged to the item 38 or picture frame 38 by a pair of connectors 54, shown to be horizontally positionable in phantom.

Open end 18 of the track 12 is downwardly disposed and elevation of the opposite end 20 of the track 12 above the head 14 of the screw 16 is determined by threaded positioning of the bolt 24 extending through the opening 22 in the wall 20 of the track 12, acting against the head 14 to raise or lower closed end 20 relative the head 14.

Once desired relative positioning is achieved by manipulation of the bolt 24, the formed engagement is locked by insertion of the locking bolt 70 as described above.

It also will be understood that the system 10 easily accommodates engagement to alarm apparatus 80 as illustrated, in its most simplistic form, in FIG. 1. Here, one common point is seen to be one of the throughbores 66 in the track 12 through which the locking connector 70 passes last when being engaged. Thus, if the connector 70 were being disengaged, it would first move out of contact with the last engaged throughbore 66.

To create an immediate awareness of attempted disengagement between structures of the system 10 one could engage the alarm apparatus 80, as schematically represented by the box 80, via a conductor 82 to the throughbore 66, in known manner such that, when the connector 70 is disengaged from the throughbore 66, it will cause the alarm apparatus 80 to activate, producing an alarm.

Alternatively, the open end 16 of the track 12 defining a noncommon point could be engaged to the alarm apparatus 80 to indicate that the head 14 of the screw 16 had moved into contact with the open end 18 of the track 12. Thus, it will be understood that various points could be engaged in known manner to the alarm apparatus 80 to indicate disengagement between various structural elements of system 10.

As described above, the system 10 provides a number of advantages, some of which have been described above and others of which are inherent in the invention. Also, modifications may be proposed without departing from the teaching herein. Accordingly, the scope of the invention is only to be limited as necessitated by the accompanying claims.

What is claimed is:

1. A hanging system for mounting an item to a vertical surface, the system comprising a track and head of an attachment member slidably engaged to one another and including means for maintaining relative position therebetween, the track having means for further engaging directly to either of said vertical surface and said item and the head being suitably directly engaged to either of said item and said vertical surface and wherein said track has a closed end and said means for maintaining relative position between said track and said head comprise a threaded member extending through said closed end of said track, said threaded member having one end which engages against said head of said attachment member.

2. The system of claim 1 further including means for releasably locking the track to the head of the attachment member.

3. The system of claim 2 wherein an alarm apparatus is engaged to at least one noncommon point on the track across which the head must pass during disengagement in a manner such that contact of the head with the noncommon point will cause alarm activation.

4. The system of claim 2 wherein said track has an open end through which the head of the attachment member is engaged within said track and said means for releasably locking said track to said head comprise a threaded connector secured across said open end of said track.

5. The system of claim 1 wherein an alarm apparatus is engaged to at least one point at least intermittently common to at least two system structures in a manner such that disengagement of one of the structures causes alarm apparatus activation.

6. The system of claim 1 wherein said track defines a hollow channel in one surface thereof opposite a surface thereof which is engageable to one of said item and said vertical surface.

7. The system of claim 1 wherein said head is engageable to one of said item and said vertical surface.

* * * * *